US007878347B2

(12) United States Patent
Alday

(10) Patent No.: US 7,878,347 B2
(45) Date of Patent: Feb. 1, 2011

(54) LIFTING APPARATUS WITH COMPENSATION MEANS

(75) Inventor: James M. Alday, Honeoye Falls, NY (US)

(73) Assignee: Gorbel, Inc., Fishers, NY (US)

( * ) Notice: Subject to any disclaimer, the term of this patent is extended or adjusted under 35 U.S.C. 154(b) by 0 days.

(21) Appl. No.: 12/333,336

(22) Filed: Dec. 12, 2008

(65) Prior Publication Data

US 2009/0152226 A1 Jun. 18, 2009

Related U.S. Application Data

(60) Provisional application No. 61/013,667, filed on Dec. 14, 2007.

(51) Int. Cl.
*B66C 23/02* (2006.01)

(52) U.S. Cl. ..... 212/223; 212/253; 212/270

(58) Field of Classification Search ..... 212/223, 212/253, 270
See application file for complete search history.

(56) References Cited

U.S. PATENT DOCUMENTS 1,769,750 A * 7/1930 Niemann ..... 212/196
2,002,727 A * 5/1935 Andren ..... 408/8
2,272,958 A * 2/1942 Wiese ..... 212/168
4,215,972 A * 8/1980 Yamasaki et al. ..... 414/742
4,435,118 A * 3/1984 Behrend et al. ..... 414/744.5
5,271,313 A 12/1993 Lindegren
5,489,032 A * 2/1996 Mayhall et al. ..... 212/285
5,733,092 A * 3/1998 Barry ..... 414/337
5,759,272 A * 6/1998 Lisec ..... 118/323
5,865,426 A 2/1999 Kazerooni
5,915,673 A 6/1999 Kazerooni
6,178,361 B1 1/2001 George et al.
6,299,139 B1 10/2001 Kazerooni
6,386,513 B1 5/2002 Kazerooni
6,394,740 B1 * 5/2002 Derby et al. ..... 414/744.1

(Continued)

FOREIGN PATENT DOCUMENTS

DE 3602912 A * 10/1986

(Continued)

OTHER PUBLICATIONS

Unofficial an international search report and written opinion dated Mar. 9, 2009 for PCT application PCT/US08/86505.

(Continued)

*Primary Examiner*—Thomas J. Brahan
(74) *Attorney, Agent, or Firm*—Duane C. Basch; Basch & Nickerson LLP

(57) ABSTRACT

The present disclosure relates to a lifting assembly such as a jib crane or similar apparatus having an articulated arm assembly and a flexible means for connecting a load to an actuator. The lift arm assembly forms an articulated cantilever boom, which is extensible so as to traverse a suspended load within a work cell area. The lift arm assembly further includes a first and second member pivotally connected to one another whereby an inclined plane (e.g., a cam) at the pivot point of the articulating arms provides a vertical displacement of the secondary arms thereby moving the distal end of the secondary arm to counterbalance inherent forces acting thereon.

18 Claims, 10 Drawing Sheets

U.S. PATENT DOCUMENTS

| | | | |
|---|---|---|---|
| 6,557,453 | B2 | 5/2003 | Paakkunainen et al. |
| 6,575,317 | B2 | 6/2003 | Taylor |
| D477,901 | S | 7/2003 | Robinson |
| 6,622,990 | B2 | 9/2003 | Kazerooni |
| 6,796,447 | B2 | 9/2004 | Laundry et al. |
| 6,886,812 | B2 | 5/2005 | Kazerooni |
| 7,028,856 | B2 | 4/2006 | Laundry et al. |
| 7,090,200 | B2 | 8/2006 | Morse et al. |
| 7,222,839 | B2 | 5/2007 | Taylor et al. |
| 2007/0023379 | A1 | 2/2007 | Kahlman et al. |

FOREIGN PATENT DOCUMENTS

| | | | | |
|---|---|---|---|---|
| FR | 2516428 | A | * | 5/1983 |
| FR | 2841887 | A | * | 1/2004 |
| JP | 6-80390 | A | * | 3/1994 |
| SU | 765050 | A | * | 9/1980 |

OTHER PUBLICATIONS

Easy Arm Intelligent Lifting System brochure depicting free-standing and under-hung embodiments; www.gorbel.com.

Donati Lifting Systems brochure Articulating Work Station JIB Cranes; www.donati-europe.com.

Gorbel, Inc.; JIB Cranes brochure Copyright 2006, Gorbel, Inc.; www.gorbel.com.

QLA35_e103;www.kahlman.com/support/download_doc/QLA35_e103.pdf;Oct. 29, 2007; Kahlman Produkter AB www.kahlman.se Quick-Lift.

QLA5075_e;www.kahlman.com/support/download_doc/QLA35_e103.pdf;Oct. 29, 2007;Kahlman Produkter AB www.kahlman.se; Quick-Lift.

QLA300_e;www.kahlman.com/support/download_doc/QLA35_e103.pdf;Oct. 29, 2007;Kahlman Produkter AB www.kahlman.se; Quick-Lift.

Scaglia Indeva brochure; www.indevagroup.co.u.

An unofficial the International Preliminary Report on Patentablility completed on Jul. 17, 2010 for PCT application PCT/US2008/086505 corresponding to U.S. Appl. No. 12/333,336.

* cited by examiner

LIFTING APPARATUS WITH COMPENSATION MEANS

This application claims priority from U.S. Provisional Application 61/013,667 for a "LIFTING APPARATUS WITH COMPENSATION MEANS," filed Dec. 14, 2007 by J. Alday, which is hereby incorporated by reference in its entirety.

The present invention is directed to a class of light duty hoists that are often used in manufacturing environments to move articles in and about a work cell or material handling within a shipping and receiving area.

BACKGROUND AND SUMMARY OF THE INVENTION

In manufacturing environments components and assemblies are often transported around the factory floor and between assembly stations using a crane having a hoist suspended from an overhead rail system. While numerous types of bridge cranes and hoists are currently available for lifting and moving objects and parts in and between work stations or cells, a particular problem inherent in these devices is the difficulty an operator encounters in accurately and controllably lifting and translating a load within a work station or between adjacent workstations; in other words enabling an operator to safely perform operations on the product without undo manual exertion, fatigue or injury.

The lifting apparatus of the present invention uniquely overcomes several drawbacks of articulated jib crane devices by providing a lifting apparatus that permits an object to be precisely lifted and moved in a ergonomic manner within or between work stations. For example, parts having an individual weight in excess of U.S. Occupational Safety and Health Administration (OSHA) lifting standards, require a lifting means to transfer the parts into and around the work station. Additionally the same lifting mechanics may be required to reach into machines or freely move the load around obstructions within the work space or a shipping/receiving dock. In order to overcome the limitations of a gantry hoist system or fixed length jib cranes, the current invention includes a free standing lifting device having an articulating jib arm that horizontally traverses or swings about the work space with only a nominal manual effort by the operator. Thus, the "double jointed" jib crane, having two arms attached to one another in one embodiment, provides for a reach zone that substantially encompasses the entire area of the work cell, while allowing movement of the load past obstacles (e.g., posts, columns, machinery) that would prevent rotation of a rigid jib crane with the same swept diameter.

Examples of such systems are found, in various publications by Gorbel, Inc., including its "EASY ARM™ Intelligent Lifting System" brochure (Copyright 2006, Gorbel, Inc.) depicting free-standing and under-hung embodiments; and "ARTICULATING WORK STATION JIB CRANES" (Copyright 2006, Gorbel, Inc.) depicting free-standing, wall-mounted and under-hung embodiments, the contents of both brochures being hereby incorporated by reference in their entirety. Various controls that may be employed in such a system, particularly those relating to the control of the load are disclosed in U.S. patents such as U.S. Pat. Nos. 5,865,426, 5,915,673, 6,299,139, 6,386,513, 6,575,317, 6,622,990, 6,796,447, 6,886,812, D477,901, 7,028,856 and 7,222,839, all of which are also hereby incorporated by reference in their entirety.

In actual practice, however, the implementation of a lifting beam consisting of articulated arms, having a load-bearing cable passing substantially within the rotational junction point of the articulated members, presents to the operator non-uniform, extraneous forces that are counterproductive to a free swinging arm(s) that will also remain in any desired stationary position, hereby referred to as a "put-n-stay" hoist operation. One solution, providing a uniform transitional force, in combination with a retained static position, would be a mechanism to provide a frictional force to resist movement of the jib arms that requires a substantial manual force to overcome the coefficient of friction before the arm(s) is able to be moved. While this approach achieves the objective of "put-n-stay" operation, the understandable limitation of the added work required by the operator to overcome the friction force prior to moving the arm makes such a solution impractical and/or requires means to actuate and release clutches, brakes or the like.

Another solution my include placing the cable/winch assembly at the distal end of the outer most arm, however the weight added to the arm assembly compounds the translation dynamics, and further reduces the load capacity of the arm. Therefore, objectives of the embodiments disclosed herein include, applying minimal uniform force to move, in a horizontal translation, a suspended load that is at rest, and once in motion the object may continue to be moved along a horizontal plane with a generally consistent force from the operator so as to facilitate positioning loads throughout area covered by the hoist or lift. Moreover, once the load is at rest the load should remain at the horizontal position, or "put-n-stay" as indicated above.

Analysis of the disclosed embodiments suggests that there may be at least three contributing factors, in various combinations, that compromise the convenience of an articulated arm having a remotely located actuator or winch (e.g., located on a central, free-standing column or ceiling structure where the articulated arm(s) are anchored as depicted in Gorbel's Easy Arm™ brochure noted above). One adverse force is due to the downward deflection of the arm(s) as a result of the combined bending moment of the articulated arms and the vertical mount of the hoist (e.g., column). This moment is a function of the linear distance of the load from the base mount and results in a force that has a tendency to cause a member to flex or bend In the embodiments disclosed, similar to the Easy Arm™ there are at least two moments. Combined with these moments is a mechanical deflection of the lifting rope or cable arising via connections of the horizontal members and the means by which the rope is passed over the pivot point of the articulated arms.

Ideally, a hoist system, absent any arm droop or deflection (i.e., vertical displacement) and forces that deviate from the centerline of the articulated arms, would only require an operator to overcome the inertia of the suspended load and nominal frictional resistance within the connecting joints between the arms. In reality, droop and other forces are intrinsic in an articulated arm when the winch or actuator is remotely located from the lifting position and where the lifting cable or rope must not constrain movement of the pivot points between the arms. For example, the early Gorbel EasyArm™ as well as the Donati (Model CBB-MBB), Scaglia/Indeva (Liftronic® Series) and Kahlman Produkter AB (QLA Series) are articulated arm lifts having designs that do not result in nearly effortless, uniform movement of the arms over the horizontal range of the lift.

Therefore, in accordance with the embodiments disclosed herein, there is provided a means to counteract, direct and otherwise control the intrinsic forces that prevent or diminish the ability of a conventional articulated arm lift to remain in a put-n-stay position where the forces promoting horizontal movement of a suspended load are essentially in equilibrium.

It is a further objective to facilitate movement of an articulated arm lift in response to a uniform transitional force that is consistently over the entire horizontal range of the lift once the load is in motion. It should be further appreciated that one source of forces tending to impact the uniform movement of the arms, or the put-n-stay operation, is that the lift cable passing over the length of the arms may result in forces tending to prevent movement or to cause movement when an operator releases a suspended load. To eliminate the impact of the cable, a design could be employed wherein the cable passes through the center of any pivot point (e.g., routed around very small pulleys, or actually through longitudinal holes in pivot pins), and thereby does not create the undesirable forces. However, such a design is believed to be impractical for safety, form and cost concerns. Referring briefly to FIG. 1, depicted in a perspective view therein is an exemplary articulated arm lift 20, a Gorbel EasyArm™ lift, having a support column 20 and primary and secondary articulated arms 24 and 28, respectively, connected thereto via pivots. The actuator or winching device 30 is located on the proximal end of primary arm 24, and controls the line or wire rope 36 that is connected to a user control 40 and load 50 suspended from a hook or other end-effector associated with the control.

There are at least two forces that produce the aforementioned objectionable circumstances as a result of the use of a cable guide pulley 32 adjacent to the pivot point 34 between the arms. One such force is the result of "droop" that occurs when a load is applied to the end of the rope 36, thereby creating a moment relative to the column and the position it is attached to the floor. This obviously varies with the location of the load relative to the column, and the height of the column. While moving the secondary (outermost) arm 28 from an in-line position relative to arm 24, the cable moves toward and contacts the pulley, thereby producing a radial force having a tendency to move the secondary arm toward an in-line position with the primary (innermost) arm. Such forces may prevent the secondary arm from remaining in a stationary position. As the secondary arm is pivoted further relative to the primary arm, the cable 36 increasingly becomes wrapped about or engages a pulley 32. Consequently, as the cable wraps about the circumference of the pulley, the moment force increases thereby producing a radial torque between the two arms. In addition, the load 50 is lifted slightly as direct function of the cable being wrapped about the pulley, thereby causing additional work as the suspended load is moved. The combination of the various forces results in a potentially imbalanced condition.

In order to enable a free-swinging, articulated arm lift, where the various interactive forces are reduced or otherwise controlled, the disclosed embodiment contemplate means to counteract or negate the forces that act to prevent movement of the load and/or preclude put-n-stay functionality. The various embodiment disclosed are intended to mitigate or reduce adverse forces that compromise a uniform and sustained effort by the operator to initiate the motion of arm/load, to sustain the arm in motion, and to assure the arm remains in a put-n-stay position when an operator-applied horizontal force to the load 50, or controller 40, is removed. As described below, the embodiments contemplate the use of mechanical cam or similar means to adjust or compensate for such forces.

It is further contemplated that alternative mechanical devices may be employed to achieve the desired operation and to compensate for the forces tending to effect movement of the load about the operating region of the articulated arm lift. Based on the recognition that work is a direct function of load displacement, maintaining a specific load/arm position to counteract reactive forces becomes one objective of the disclosed embodiments. In other words, effectively maintaining the vertical height of the load provides a generally constant potential energy (height) of the load to enable the arms to freely rotate relative to one another through the operating region and to stay in place once the operator stops moving the load; since the load will not be seeking a lowest-height position.

In accordance with one embodiment, a cam follower is situated to be responsive to the lobe of a cam that is positioned at least partly about, or near the pivot point of the lift arm assembly (between the primary and secondary arms), whereby the cam follower progressively modifies the vertical angular elevation of the secondary arm with respect to the primary arm, while the arm is being moved about the operating region of the articulated arms. The technique described herein is advantageous because it provides for an adjusting or compensating force that serves to counterbalance the previously identified inherent forces resulting from loading of the articulated arms and the lift cable or rope passing over pulleys adjacent the pivot points. The improved performance achieved using the combination of a cam and cam follower permits a more uniform manual force to induce and control the traversing of a suspended load attached to the arm. Furthermore, once the load is in motion the sustaining force is maintained by virtue of the varying cam radius associated with the relative radial position between the arms.

This technique is also advantageous because various cam profiles can be readily produced to accommodate a broad range of application specific variables. Therefore, a plurality of alternative cam lobes and configurations could be useful in providing the most appropriate and effective solution in any given situation. It will be further appreciated that the cam may be customized, not only for the typical loading of the articulated arms, but also for a particular workstation, where the operator may wish to have detents (e.g., localized changes such as bumps or divots) within the cam profile for specific arm orientations (relative to the primary arm) where the secondary arm "clicks" into a pre-established location, thereby eliminating overshoot and arm wandering, although an extra effort may required to initially dislocate the arms from such a position and to move a load to another position.

According to one embodiment, there is disclosed a lifting apparatus, comprising: a base; a primary arm pivotally coupled to said base; a secondary arm pivotally coupled to the distal end of said primary arm, thereby permitting free swinging movement of said arms within a generally horizontal plane defined by the primary and secondary arms; an actuator operatively associated with at least one of said arms, said actuator operatively engaging a cable so as to control the height of a load suspended from a free end of the cable beneath the distal end of the secondary arm; and a mechanical adjustment for displacing the second arm relative to the first arm and thereby counterbalance forces acting upon the secondary arm as a result of movement of the load suspended therefrom.

In accordance with a second embodiment, there is disclosed an articulating arm assembly for connecting a lifting device to a load, comprising: a first arm operatively attached to a support at a proximal end thereof and including a pivot pin at a distal end thereof; a second arm having a first member pivotally coupled by said pin to the distal end of said first arm and a second member adjustably coupled to the distal end of said first arm for permitting free swinging movement of said arms relative to one another; a cable between the lifting device and the load that mechanically constrained to pass lengthwise along said first and second arms; and a cam, positioned in proximity to and interposed between the pivot pin and the second member of the second arm, said cam angularly displacing the second member in a vertical direction relative to said first member.

In accordance with yet another embodiment, disclosed herein is a method for controlling the position of an articulated arm lift, comprising: operatively attaching a primary arm to a support at a proximal end thereof, said primary arm including a pivot pin at a distal end thereof; and pivotally coupling, using a pivot pin, a secondary arm to said primary arm to permit free swinging movement of said primary and secondary arms relative to one another, wherein the vertical angle between the primary arm and secondary arm is variably adjustable using a cam positioned in proximity to and interposed between the pivot pin and a portion of the secondary arm, said cam thereby angularly displacing the secondary arm in a vertical direction relative to said primary arm as said arms are horizontally pivoted relative to one another.

Other and further objects, features and advantages will be apparent from a reading of the following specification and by reference to the accompanying drawings forming a part thereof, wherein the examples of the disclosed embodiments are given for the purposes of disclosure.

DETAILED DESCRIPTION

Figure 1:
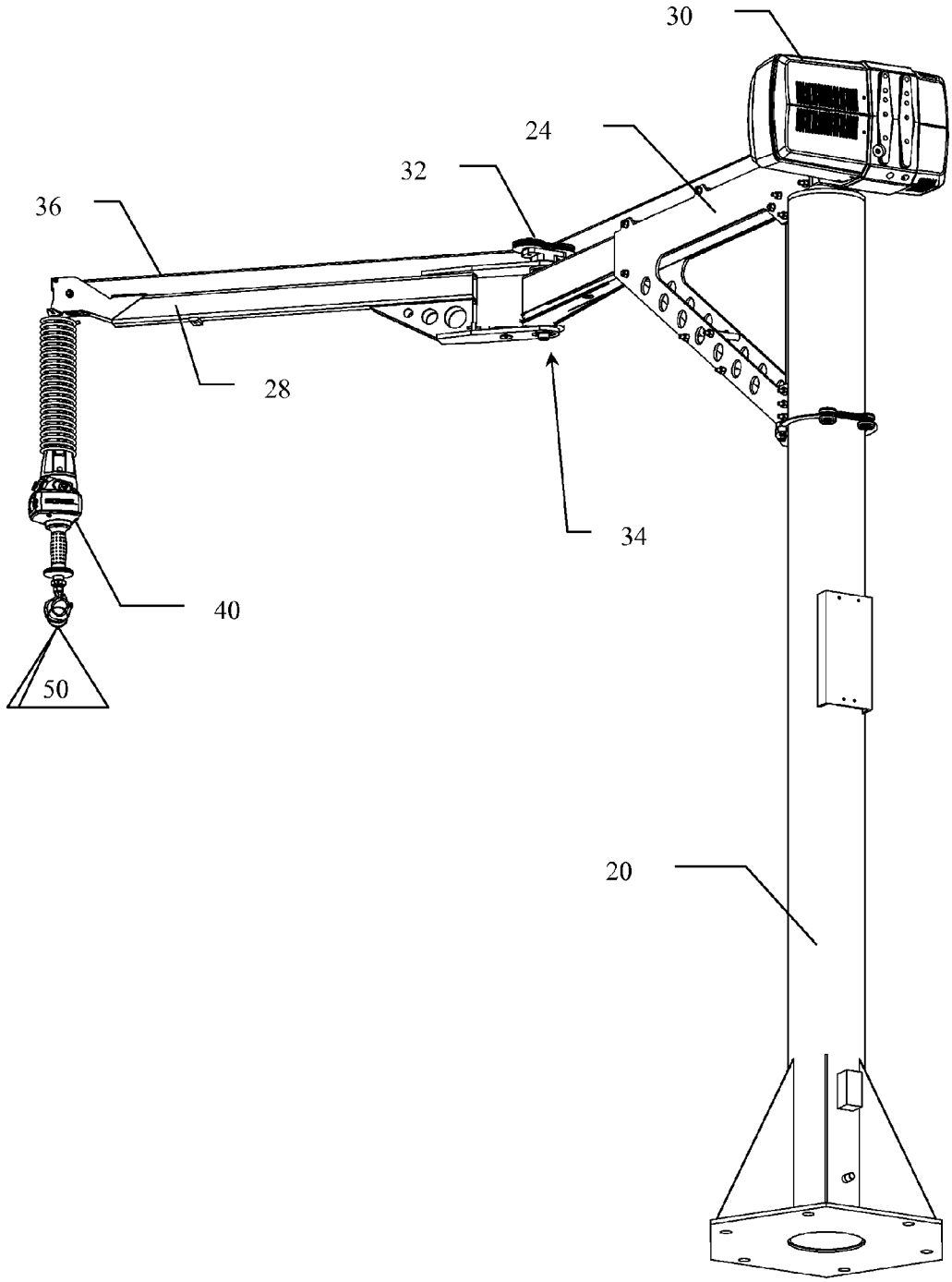
FIG. 1 is a perspective view of an articulated arm lift device as briefly described above.

For a general understanding of the disclosed embodiments, reference is made to the drawings. In the drawings, like reference numerals have been used throughout to designate identical elements.

Figure 2:
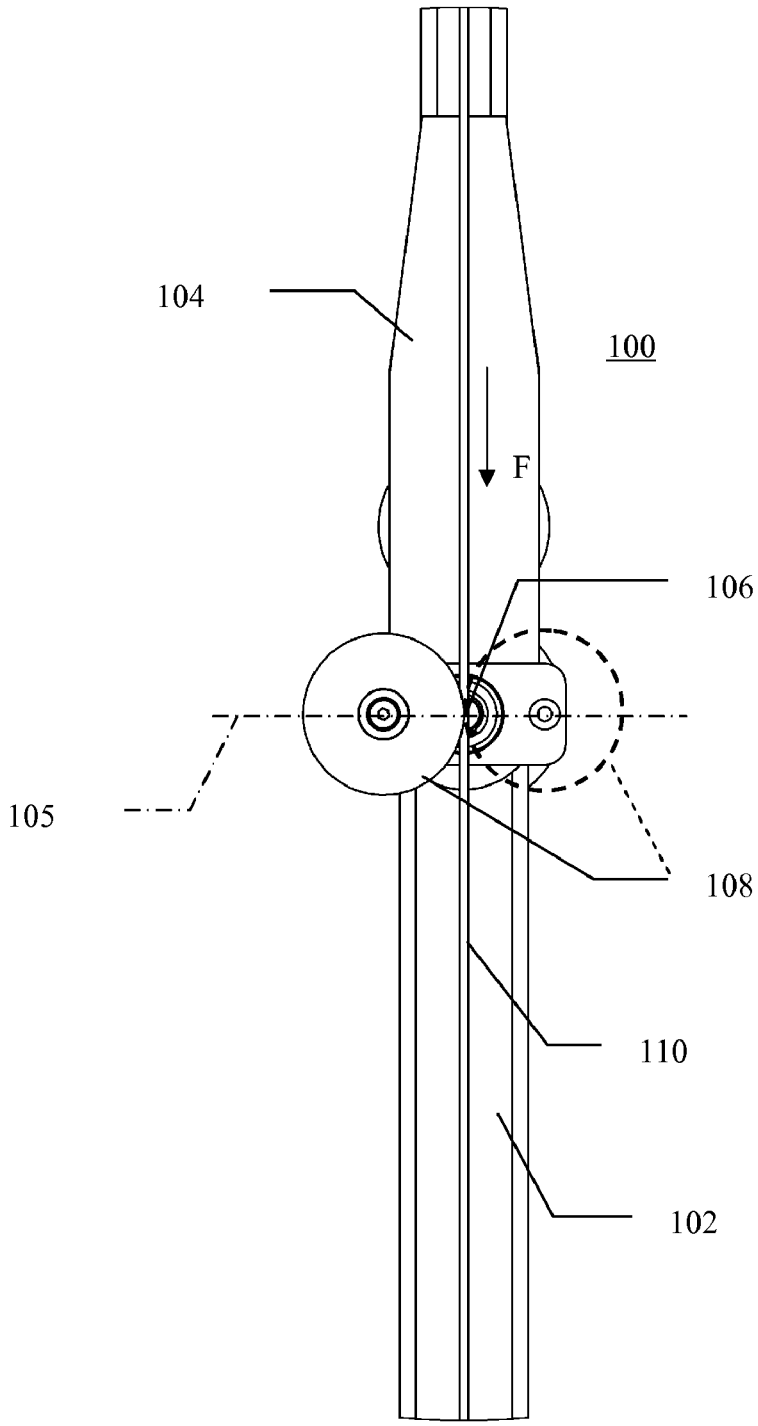
FIG. 2 is a partial top-view of the articulated arm pivot embodiment as described below.
Figure 3:
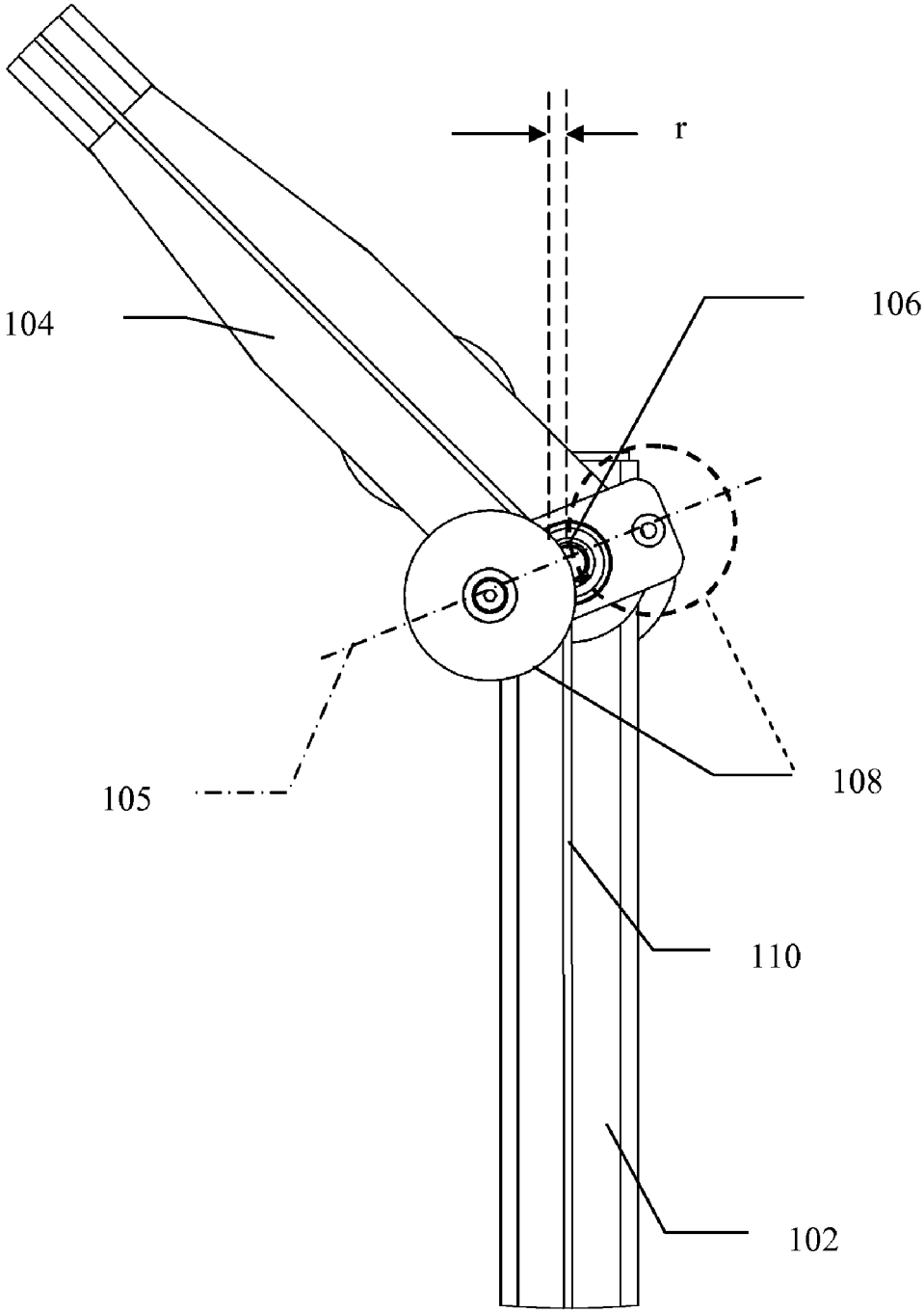
FIGS. 3-5 are also partial top-views of the articulated arm pivot of FIG. 2, positioned at about a 45, 90 and 120 degree angles.

Considering the figures, controlled and uniform motion of the articulated arms is compromised by a combination of forces. One force results from the cable 110 consistently pulling the secondary arm 104 towards an equilibrium position, this force results from the tension on the lifting cable, particularly when a load is suspended therefrom, and the offset of the cable from the centerline of the pivot point. Referring for example to FIGS. 2 and 3 the clevis or pivot pin 106 defines the center of the pivot and any offset of the cable from such a position, as shown in FIG. 3, produces a moment between a cable tangent point on pulley 108 and pin 106. Another force is the result of the load being vertically displaced as a function of arm pivoting and wrapping of the cable about the pulley when the arms are moved relative to one another. Yet another force is derived from the bending moment of the articulated arms and an associated column or support structure.

Figure 4:
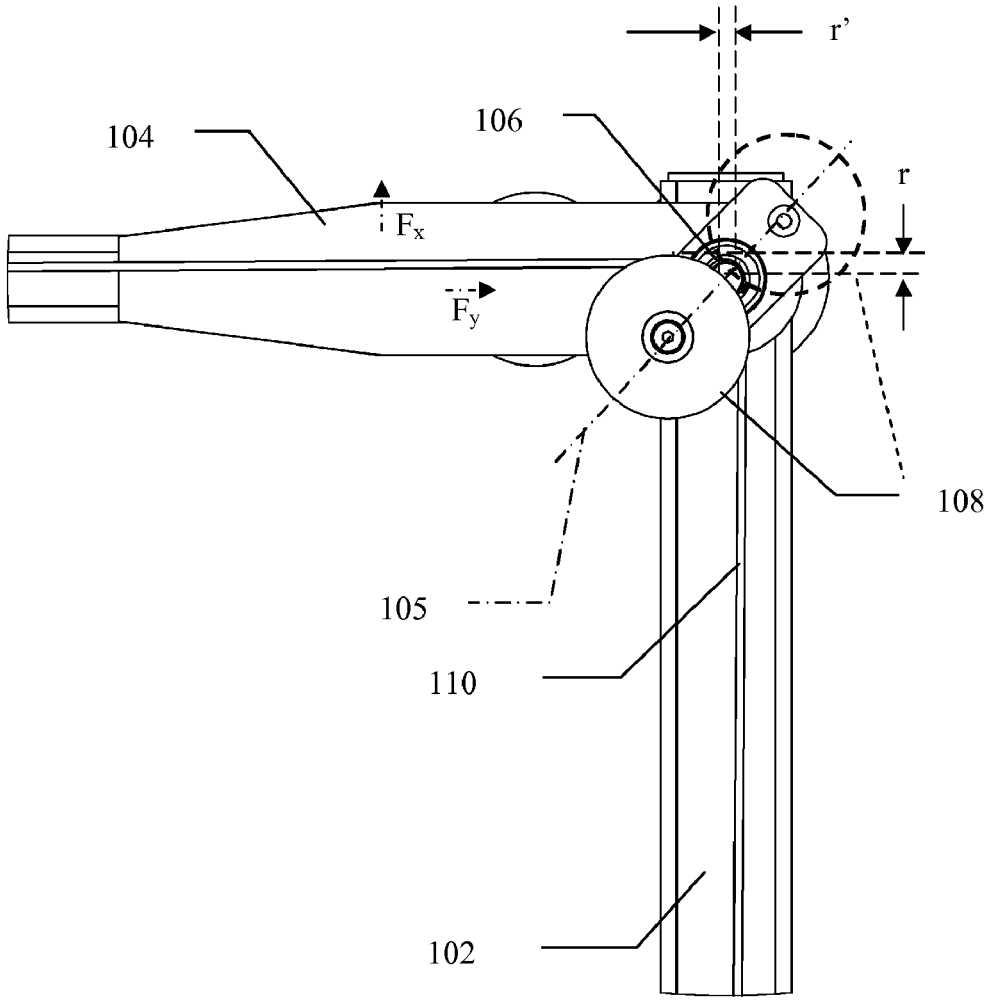

The offset, denoted as distance "r" in both FIGS. 3 and 4 represents the distance measured between the cable and the pivot point. This radial moment, in conjunction with wrapping of the cable 110 about pulley 108 tends to resist pivoting of the secondary arm relative to the primary arm, as well as, potentially causing the secondary arm to move after being released by the operator.

Reference is now made to FIGS. 2-4, where various positions of primary and secondary arms 102 and 104 are illustrated according to the following stages of movement:

Stage 1—(aligned) In FIG. 2 cable 110 passes substantially over the centerline of arms 104 and 102, therefore there is no offset and accordingly no force moment or cable wrapping about pulley 108 is evident. However, a moment caused by the load 116 suspended at the distal end of secondary arm 104 is at a maximum, therefore the arms are deflected downward. In some embodiments, due to the cable tension caused by the load, the arms are not inclined to freely articulate from the generally aligned configuration of FIG. 2 without a considerable sidewise force to "snap" them off their respective centerline.

Stage 2—(arms @ ~45 degrees) As seen in FIG. 3, a minor moment force develops as the cable moves off-center and begins to make contact with the outer circumference of pulley 108. Additionally, as the angle between the arms decreased (from a maximum of 180° when aligned), the load is moved closer to the column or support, thereby reducing the bending moment.

Stage 3—(arms @ ~90 degrees) At this point, shown in FIG. 4, cable 110 has now completely moved across the open space between arm 104 centerline and the circumferential surface of the pulley 108. Notably cable 110 is increasingly wrapped about the radius of pulley 108, thereby progressively raising the vertical position of the load.

Figure 5:
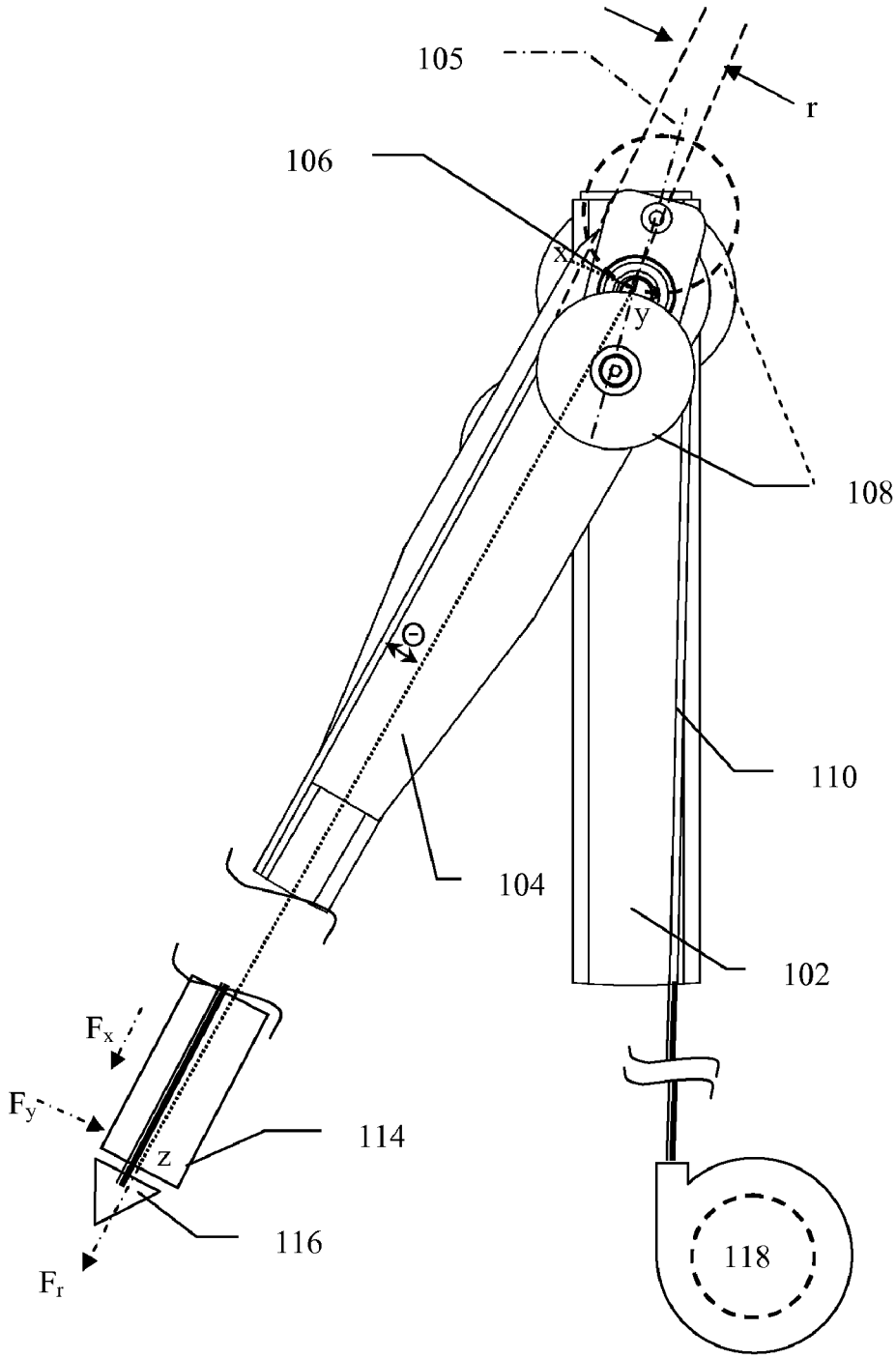

Stage 4—(arms @ ~120 degrees) As represented in FIG. 5, cable 110 continues to cause a larger moment (deflection from the center of the arms) as it wraps about the circumference of the pulley. Additionally, the wrapping about pulley 108 further causes cable 110 to shorten thereby further raising load 116 —resulting in additional work=(force)(distance).

Stage 5—(fully retracted) The cable is now substantially wrapped about approximately one-half of the pulley circumference and the maximum radial torque is present, as well as the maximum amount of work expended to attain the load position. However, the moment caused by the load is at a minimum, therefore the arm deflection or droop is also near a minimum.

Referring to FIGS. 3 and 4, secondary arm 104 is illustrated as having been translated into a position where cable 110 is now displaced from the centerline of secondary arm 104. Accordingly the associated radial force derived from moment r and r' is a function of the included angle between the cable and the x and y force components, or more specifically as depicted in FIGS. 3-4, the tangential force from the point of contact of cable 110 onto pulley 108 applies an off-center force $F_r$ to the pivot point by way of moment "r". Accordingly, moment "r" is equal to the $F_y$ component divided by the sine of the deviation angle of cable 110 from the centerline, expressed as θ, or simply:

$$F_r = F_y / \sin\theta \text{ in triangle } xyz,$$

where $F_y$ is a component of $F_r$.

In other words, as angle θ increases so does $F_r$ and the corresponding radial torque (τ) derived from $F_r$ acting upon secondary arm 104, also increases where $\tau = r(F_r)$.

Turning next to the second force, the figures demonstrate that as secondary arm 104 continues to pivot about the pivot at pin 106, cable 110 increasingly engages the perimeter of pulley assembly 108, which in turn further raises the load. For example, as observed in FIG. 3, the curvilinear cable contact distance at 90-degrees is equal to about one-quarter the circumference. This second force can be generally characterized as the fundamental work required to raise/lower the load as the secondary arm is rotated about the pivot and relative to the primary arm.

Figure 6:
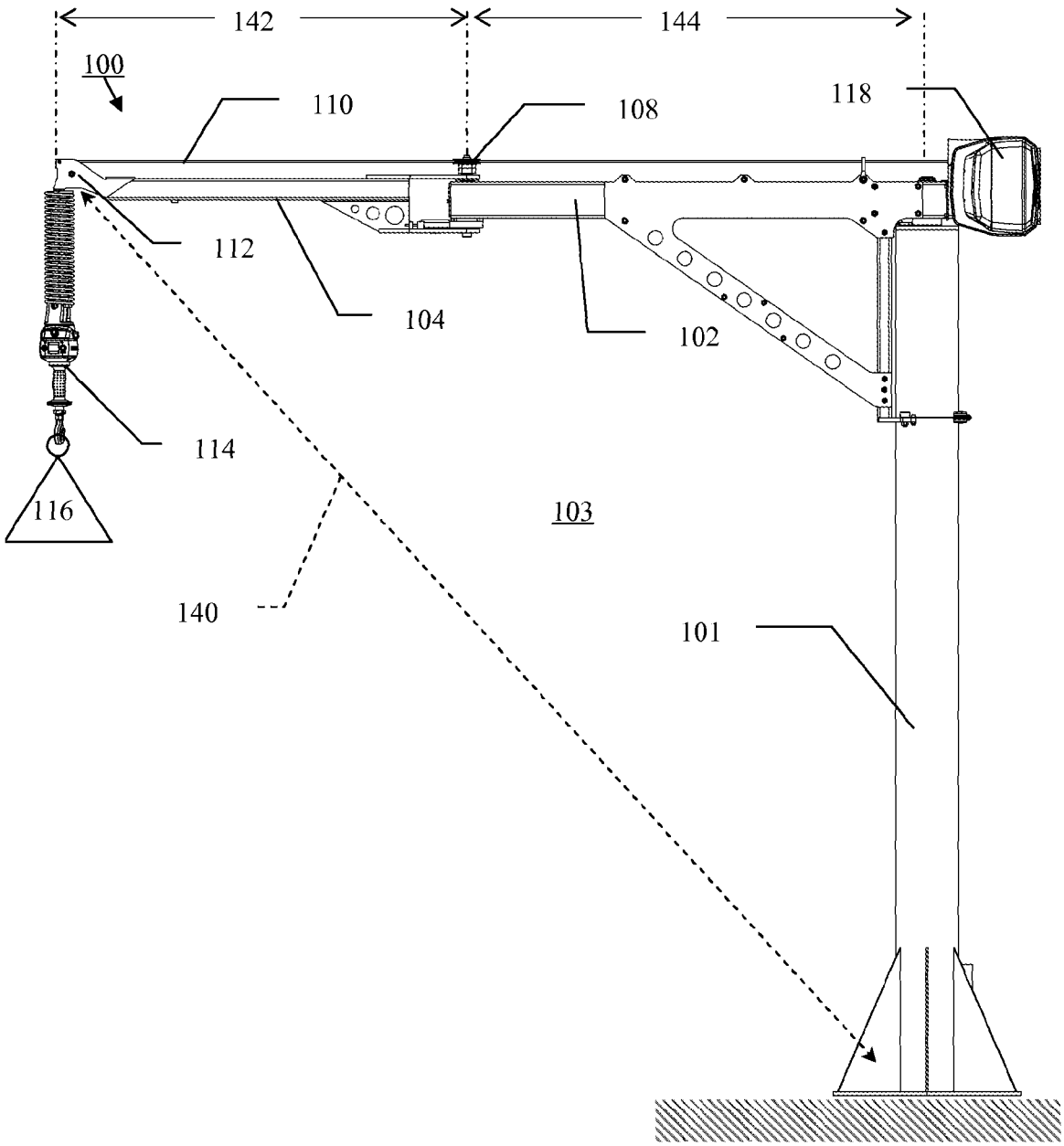
FIG. 6 is a planar overview of an articulated arm lifting device in accordance with the embodiments disclosed below.

Referring also to FIG. 6 another force is present, which is attributed to the secondary arm length 142, primary arm length 144 and further relative to distance 140. In the depicted embodiment deflection or droop and includes at least two components, a bending and a torsion moment. In regard to the bending moment, this force component is directly proportional to distances between the base and the load, therefore is at a maximum force at Stage 1 above and near a minimum at Stage 5. Conversely, a torque or twisting moment on primary arm 102 is a minimum at Stage 1 and approaches a maximum at Stage 3. Therefore the negative deflection angle of the distal end of secondary arm is anticipated to be the greatest between Stage 1 and Stage 2.

The significance of the combined bending and torsion forces is the tendency for the distal end of arm 104 to droop as a result of the perpendicular load applied to the end of secondary arm 104. As with the previously characterized forces, this force is also variable as the secondary arm is pivoted through Stages 1-5. Nevertheless, it is a force component, that must be contemplated within the overall transitional force equation and therefore equalized accordingly.

Referring, once again, to FIG. 4, there is depicted an overall embodiment of a lifting assembly 103 having pedestal or base 101 which may include a post or column (as shown), or a wall or under-hung support structure. Pivotally connected to the base is a lift arm assembly 100 having cable 110 connecting load 116 to actuator 118. Lift arm assembly 100 forms an articulated cantilever boom extending from lift pedestal 101, and is pivotable so as to move load 116 in a work area or region of operation within reach of the arm assembly 100. Lift arm assembly 100 further includes primary arm 102 pivotally connected by means of clevis or pivot pin 106 and clevis members to a secondary arm 104. Actuator 118 and its associated end effector are designed to grip and control the position of a load 116. In one embodiment, the actuator and end effector may be as described, for example, in detail in U.S. Pat. No. 7,222,839 or US Publication 2007/0205405, both hereby incorporated by reference, where the actuator and end effector are designed to lift load 116 when gripped by a human hand, particularly in response to a measured human-applied force to the load or end effector (i.e., the force applied by the human operator against the load or handle, etc).

Lift arm assembly 100, as seen in FIGS. 7-8 and 11-13, includes a pivot coupling at approximately its midpoint, at the respective ends of the primary and secondary arms depicted in the figure, and constrained to move the secondary arm relative to the primary arm in a generally radial manner by clevis members 107*a*, 107*b* on the end of the secondary arm. More specifically, the clevis members 107*a, b* engage, preferably via bearings (top and bottom), clevis pin 106 at the junction of the distal end of primary arm 102. In operation, the bearing affixed to the top clevis member 107*b*, while permitting the arm 104 to pivot relative to arm 102, also permits movement of the distal end of arm 104 in a vertical orientation. Thus, the bearing in the top clevis 107*b*, permits "spherical" movement as the lower bearing about pin 106 slides within the slot 126 in clevis member 107*a* as described below in more detail.

Primary and secondary arms 102 and 104, working in unison, allow transporting of a suspended load from the free end of the secondary arm essentially anywhere within an arcuate area about lift pedestal 101 or a similar base. The area is generally defined by a radius equal to the combined length of the articulated arms and further dependant on any travel-limits such as bumpers or stops at the pivot points. Cable 110 is secured to or within the take-up mechanism of actuator 118 and passes through pulley assembly 108 (e.g., one or two pulleys) and then over a pulley 112 at the distal end of the secondary arm and align with end effector 114 and accordingly load 116. Cable 110, as used herein, may include stranded or solid cable, rope, line or wire, as well as chain, strap, hose or other member for transmitting a tensile lifting force between an actuator and a load.

Pulley assembly 108, as shown in FIG. 6, is strategically oriented such that the center of the assembly freely pivots about clevis pin 106, and the assembly is permitted to pivot in response to cable 110, as the cable wraps about the pulley in cooperation with the translational movement of secondary arm 104. Generally, the angular orientation of assembly 108 is a function of the position of the secondary arm relative to the primary arm, and may be characterized as the centerline of the pulleys (line 105, FIG. 2) in assembly 108 generally bisecting the included angle formed between the primary and secondary arms, 102 and 104 respectively.

Figure 7:
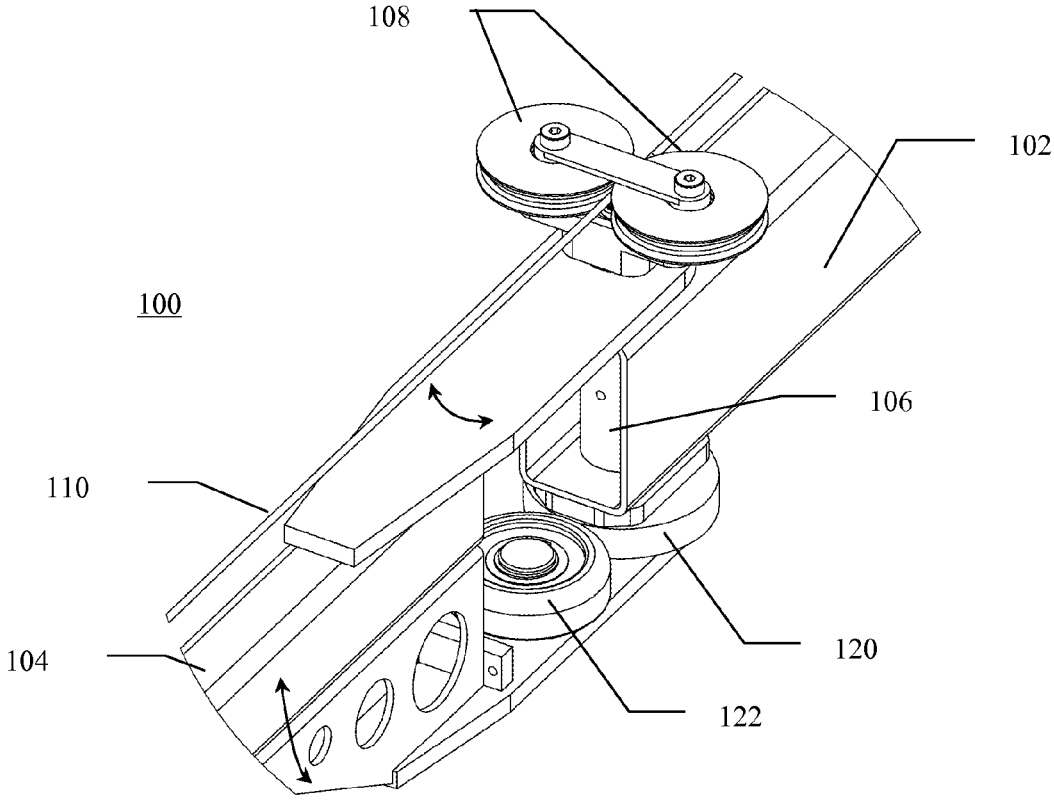
FIG. 7 is a perspective cut-away view of the pulley assembly in an embodiment employing an offset of the secondary arm.
Figure 8:
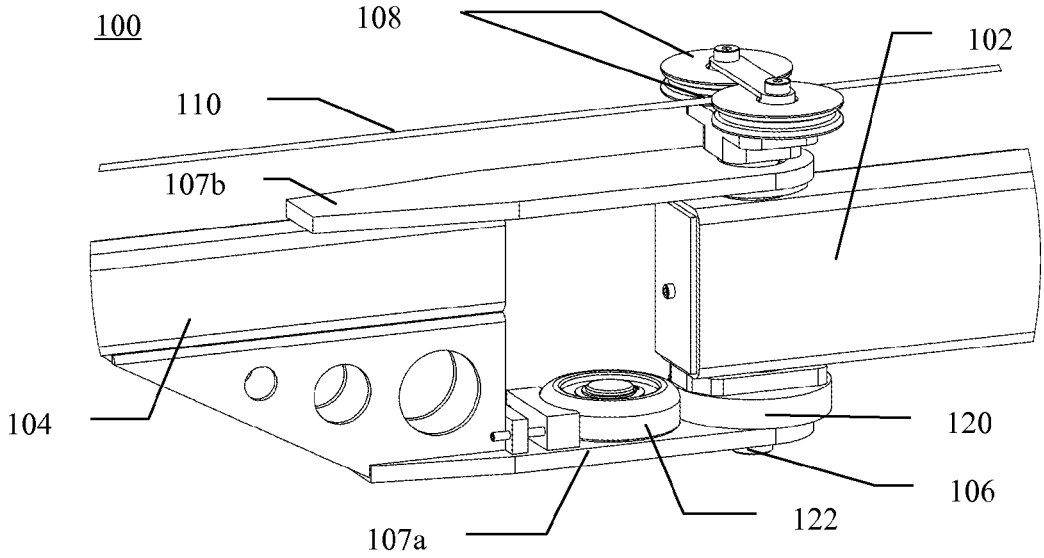
FIG. 8 is a perspective view of the pivot connection of the articulated arms including a cam.

Having described the basic operation of the lift assembly 103 and the associated mechanical elements, attention is now turned to various aspects of the embodiments designed to compensate for the various forces discussed above. Counter-productive forces are experienced when cable 110 moves off of the centerline of secondary arm 104—when the secondary arm is pivoted relative to the primary arm. As previously noted in FIGS. 2-6, cable 110 has an intrinsic propensity to deviate from the centerline as a function of the wrap about either one of the pulleys 108. However, by altering the droop angle of arm 104, it is possible to raise and lower load 116 to create a counterbalancing force and thereby control both the radial moment and translation forces to a point where they counteract and substantially cancel the extraneous forces. As seen in FIGS. 7 and 8 one implementation relies predominantly on a cam 120 interposed between the articulated arms and is securely attached to primary arm 102 about clevis pin 106. Cam follower 122 is rotationally attached to secondary arm 104 via a lower clevis member 107*a* and is responsible for causing the angular displacement of arm 104, in a vertical direction, as it reacts to the arcuate profile of cam 120. Accordingly, as arm 104 pivots about pin 106 it now has two degrees of freedom, horizontally to move the load within the operating region, and vertically as a force modifier caused by the cam profile.

The effectiveness of the cam/cam follower arrangement depicted in FIGS. 7-13 in counteracting or correcting for the adverse forces is directly reliant on the cam profile, which may be modeled based upon various load ranges and which may also be empirically derived based on, or characterized by, observation and experimentation with a specific embodiment. It should be understood that the cam and cam follower may also be associated with the top clevis member and/or with the primary arm, albeit possibly with greater risk of failure of components in the arm/pivot, and that alternative mechanical means may be similarly employed such as an inclined plane, elliptical pivot pin, and the like, to achieve the desired angular vertical adjustment of the secondary arm relative to the primary arm. Also to be noted is a desirable degree of swivel or play, as the clevis pin is tilting in and out, between the inner and outer race of an upper ball type bearing that is present between upper clevis 107*b* and the pin 106. Such a bearing is consequently identified as self-aligning in order to accommodate angular misalignments of clevis pin 106 and is particularly suitable for the present application where deflections or misalignment are intentionally developed.

Figure 9:
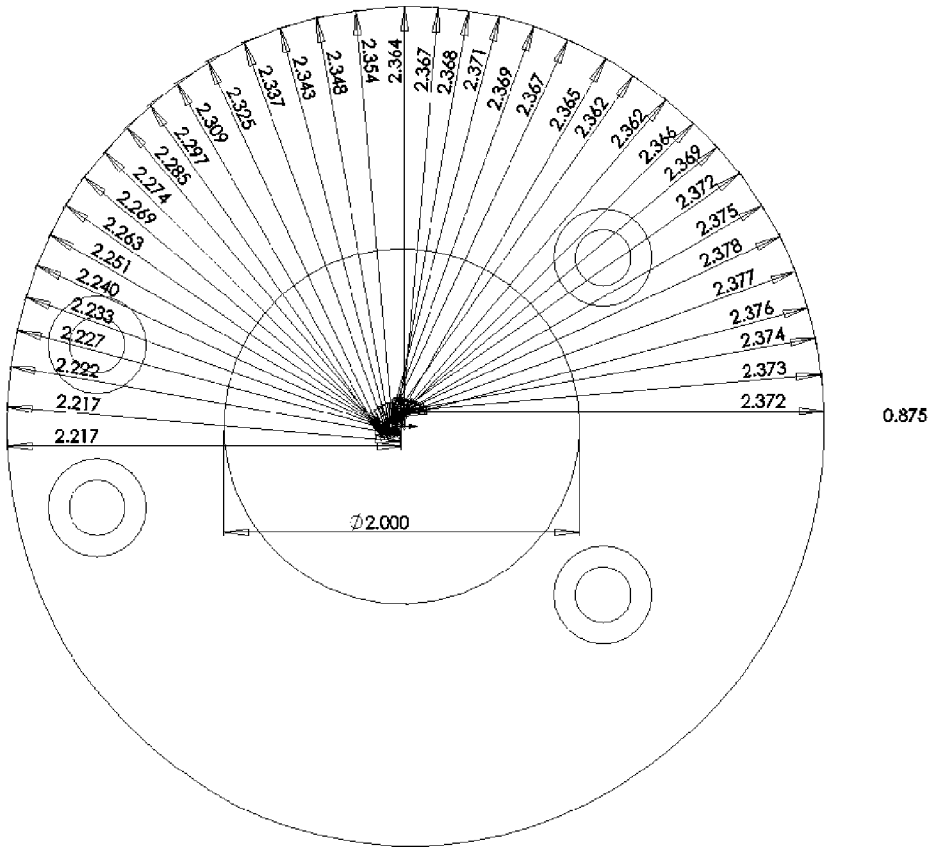
FIG. 9 is an illustration of an exemplary cam.
Figure 10:
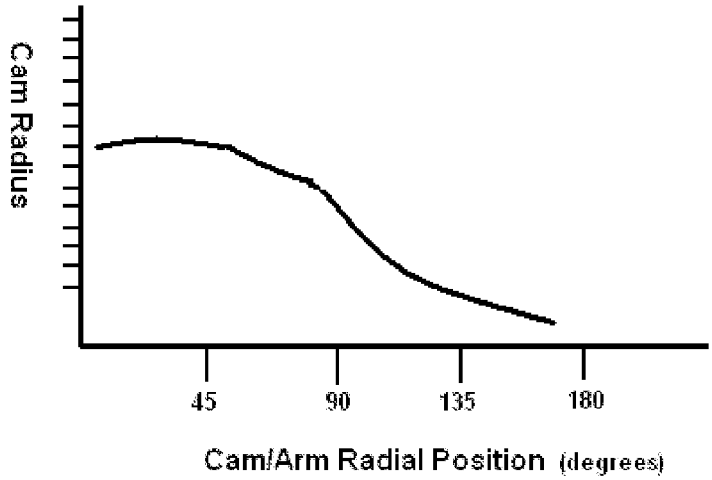
FIG. 10 is a generalized graphical representation of an exemplary cam profile (radius) relative to the angle at the pivot point between the primary and secondary arms.

As will be further appreciated, the cam profile is necessarily a function of the length and geometry of the articulated arms 104 and 104, the pulley assembly 108, as well as the weight of the load suspended from the free end of the secondary arm. One embodiment of a cam profile is depicted in FIG. 9. The example cam radius graph of FIG. 10 (shown for a single-direction pivot only) is a generalization showing the cam radius or slope of the lobe versus the angular position of the arms relative to one another.

Figure 11:
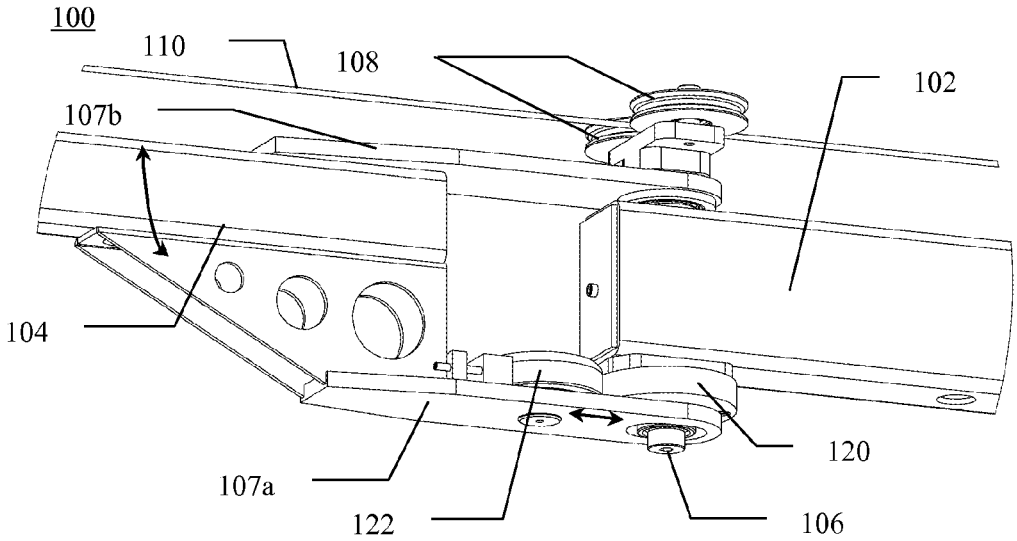
FIG. 11 is a bottom perspective view of the pivot junction between the primary and secondary arms.
Figure 12:
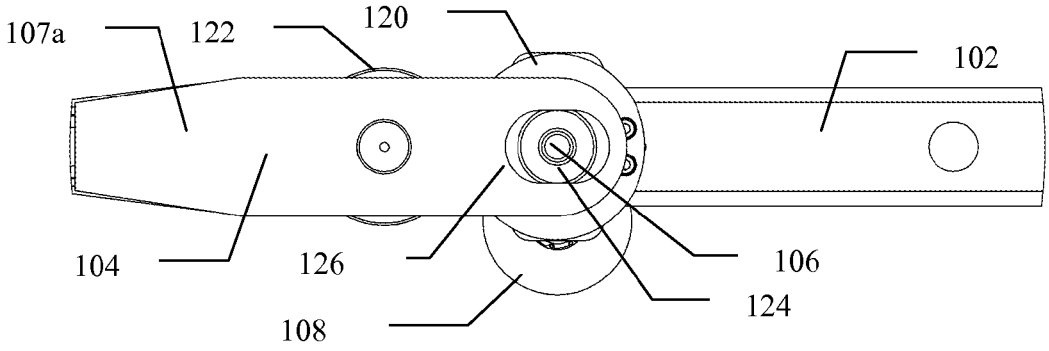
FIGS. 12 and 13 are perspective bottom views of the junction between the primary and secondary arms showing a bearing slot and cam follower at two different angular orientations of the arms.
Figure 13:
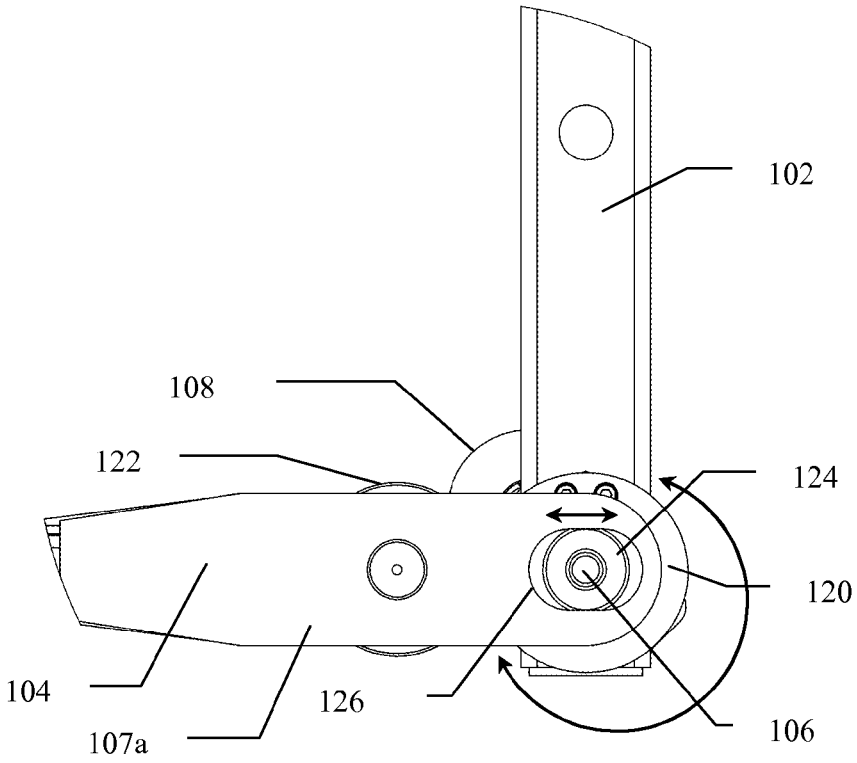

Turning to FIGS. 11-13, clevis pin 106 and bearing 124 are shown as being moveable along the centerline of secondary arm 104 (dashed line in FIGS. 12 and 13) within bearing slot 126. Bearing slot 126 is aligned with its long axis also along the same longitudinal axis as cam follower 122 and allows lower clevis member 107*a* to translate, in response to motion developed by cam 120, only in the direction of the center axis of secondary arm 104. Accordingly, the upper clevis pin bearing (not shown) is constrained within arm 102, and affords a vertical movement pivot point for the upper clevis member (107*b*) as the lower clevis member 107*a* "skews" as a result of the cam induced vertical motion of arm 104—hence the preference for a self-aligning upper bearing that is compliant with off axis tilt of clevis members 107*a,b*.

As depicted in FIGS. 12 and 13, as arm 104 rotates, cam follower 122 remains engaged with cam 120 and causes the lower clevis member 107*a* to move in and out along the axis depicted, thereby resulting in a raising-lowering of the distal end of the secondary arm. In one embodiment, cam 120 is oriented such that the cam radius at a first rate of change increases to cause secondary arm 104 to pivot upwardly from being in-line with the primary arm and through a 90-degree position and then generally decreases at a greater rate of change in radius until the arm 104 becomes almost completely folded back. FIG. 9 graphically characterizes one possible example of the cam radius (translating to resultant vertical motion of the distal end of lift arm assembly 100) as a function of the cam induced angle between the primary and secondary arms. It will be appreciated that empirical information may result in a cam profile that is similar or entirely different to that depicted.

Furthermore, as suggested previously, a cam profile may be applicable for a particular lift configuration (e.g., size/construction) and a different profile may be applicable for alternative configurations. It is also believed that the cam profile is likely to be applicable only to a range of loads, such that alternative profiles may need to be used when larger or smaller loads are suspended from the end of the secondary arm via the cable. And, customized cam profiles may also be used so that the operation or performance of the articulated arm lift may be adjusted or tuned to a particular application (e.g., having one or more detents or similar structures on the cam to prevent or encourage movement to certain angles between the primary and secondary arms.

In recapitulation, disclosed is a method and apparatus for compensating for inherent forces developed within an articulated arm lifting mechanism. The disclosed technique employs a cam or equivalent mechanism to provide a counteracting force by adjusting the elevation of the secondary arm and load as the load is traversed.

It is, therefore, apparent that there has been provided, in accordance with the present invention, a method and apparatus for adjusting the angular position of one member of a jib crane with articulating arms to counteract forces tending to resist movement of the arms relative to one another or through certain positions and thereby improve the lift system. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A lifting apparatus for lifting a load, comprising:

a base;

a primary arm pivotally coupled to said base wherein pivotal movement of the primary arm relative to said base defines a generally horizontal plane;

a secondary arm pivotally coupled to said primary arm near the distal end of said primary arm, where the load is suspended from a distal end of said second arm;

an actuator operatively associated with at least one of said arms, said actuator operatively engaging a cable to control the height of a load suspended from a free end of the cable beneath the distal end of the secondary arm; and a mechanical adjustment for variably displacing the second arm relative to the first arm while the arms are moving relative to one another and thereby counterbalance forces acting upon the secondary arm as a result of movement of the load suspended therefrom to maintain the load within a generally horizontal plane.

2. The apparatus of claim 1, wherein said actuator is operatively attached to said primary arm and said cable passes over a pulley located adjacent to the pivot coupling between the primary and secondary arms.

3. The apparatus of claim 1, wherein the mechanical adjustment for displacing the second arm relative to the first arm includes a cam and an associated cam follower.

4. The apparatus of claim 1, wherein the mechanical adjustment for displacing the second arm includes an inclined plane.

5. The apparatus of claim 4, wherein said inclined plane is positioned about the pivot coupling of the primary and secondary arms to continuously control the vertical position of the secondary arm relative to the primary arm as the secondary arm is pivoted relative to the primary arm.

6. A lifting apparatus, comprising:

a base;

a primary arm pivotally coupled to said base;

a secondary arm pivotally coupled to the distal end of said primary arm, thereby permitting free swinging movement of said arms within a generally horizontal plane defined by the primary and secondary arms;

an actuator operatively associated with at least one of said arms, said actuator operatively engaging a cable so as to control the height of a load suspended from a free end of the cable beneath the distal end of the secondary arm; and a mechanical adjustment for displacing the second arm relative to the first arm and thereby counterbalance forces acting upon the secondary arm as a result of movement of the load suspended therefrom, wherein the mechanical adjustment for displacing the second arm relative to the first arm includes a cam and an associated cam follower and said cam is attached to an end of the primary arm about the pivot coupling, and where the cam follower is attached to the secondary arm.

7. The apparatus of claim 6, wherein said cam follower is positioned to continuously contact a surface of the cam as the secondary arm is pivoted relative to the primary arm.

8. An articulating arm assembly for connecting a lifting device to a load, comprising:

a first generally horizontal arm operatively attached to a support at a proximal end thereof, the lifting device operatively associated with said first arm, and said first arm further including a pivot pin at a distal end thereof;

a second arm having a first member pivotally coupled by said pivot pin to the distal end of said first arm and a second member adjustably coupled to the distal end of said first arm for permitting free swinging movement of said arms relative to one another via the pivot pin, wherein a cable between the lifting device and the load is mechanically constrained to pass lengthwise along said first and second arms and thereby support the load from the distal end of the second arm; and a cam, positioned in proximity to and interposed between the pivot pin and the second member of the second arm, said cam angularly displacing the second member in relative to said first member, said cam thereby causing the distal end of the second arm to operate within a generally horizontal plane.

9. The articulating arm assembly of claim 8, further including an actuator as the lifting device.

10. The articulating arm assembly of claim 8, wherein the cam is an annular cam.

11. The articulating arm assembly of claim 10, wherein said second member of the second arm further includes a cam follower.

12. The articulating arm assembly of claim 8, further including at least one pulley in proximity to the pivot pin, wherein the cable passes over the at least one pulley.

13. The articulating arm assembly of claim 8, wherein the cable includes a linked chain.

14. A method for controlling the position of an articulated arm lift, comprising:

operatively attaching a primary arm to a support at a proximal end thereof where said primary arm extends in a generally horizontal orientation, said primary arm including a pivot pin at a distal end thereof; and pivotally coupling a secondary arm to said primary arm to permit free swinging movement of said primary and secondary arms relative to one another in a generally horizontal orientation, while variably displacing the secondary arm relative to said primary arm as said arms are pivoted relative to one another.

15. The method according to claim 14, wherein the angle between the primary arm and secondary arm is variably adjustable in response to a cam assembly positioned in proximity to and interposed between a pin pivotably connecting said arms and a portion of the secondary arm.

16. The method according to claim 15, further comprising stringing a cable between a lifting device and a load suspended from the distal end of the second arm, said cable being mechanically constrained to pass lengthwise along said first and second arms.

17. The method of claim 16, further comprising:

moving said load in a transverse direction to cause a change in the forces acting thereon; and concurrent with moving the load, said cam adjusting the angle of the secondary arm relative to the primary arm to permit the load to be moved with generally uniform force throughout a range of transverse motion that may be covered by the articulated arm lift.

18. The method according to claim 17, wherein the cam adjusts the vertical displacement of the secondary arm and the suspended load such that the load remains stationary when no additional force is applied to the load.

* * * * *